United States Patent [19]

Miyazaki

[11] 4,440,504

[45] Apr. 3, 1984

[54] ELECTRONIC TIMEPIECE INCLUDING A PIEZOELECTRIC ALARM

[75] Inventor: Hajime Miyazaki, Suwa, Japan

[73] Assignee: Kabushiki Kaisha Suwa Seikosha, Tokyo, Japan

[21] Appl. No.: 288,610

[22] Filed: Jul. 30, 1981

[30] Foreign Application Priority Data

Aug. 7, 1980 [JP] Japan ..... 55-108520

[51] Int. Cl.[3] ..... G04C 21/16

[52] U.S. Cl. ..... 368/255; 368/204

[58] Field of Search ..... 368/203, 204, 255, 250, 368/280

[56] References Cited

U.S. PATENT DOCUMENTS

| | | | |
|---|---|---|---|
| 3,780,522 | 12/1973 | Yoshida | 368/255 |
| 3,879,931 | 4/1975 | Yasuda et al. | 368/255 |
| 3,992,870 | 11/1976 | Dekel | 368/280 |
| 4,051,665 | 10/1977 | Arn | 368/280 |
| 4,068,461 | 1/1978 | Fassett et al. | 368/255 |
| 4,250,573 | 2/1981 | Saito | 368/250 |

*Primary Examiner*—F. W. Isen

*Attorney, Agent, or Firm*—Blum, Kaplan, Friedman, Silberman and Beran

[57] ABSTRACT

An electronic timepiece including a piezoelectric type alarm buzzer wherein the caseback functions as the buzzer diaphragm is provided. The piezoelectric element is mounted on the caseback and a battery for driving the timepiece is mounted on the piezoelectric element with an electrical insulating member therebetween for preventing short-circuiting between the battery and piezoelectric element. In an exemplary embodiment, the electrical insulating member for mounting for holding the battery is mounted to the piezoelectric element at a peripheral portion in order not to effect adversely the sound level. Alternatively, when design considerations require the battery may be mounted in a more central portion of the piezoelectric element, an angular insulating member having a central opening is used so that the insulating member contacts the piezoelectric element at the periphery thereof.

10 Claims, 10 Drawing Figures

ELECTRONIC TIMEPIECE INCLUDING A PIEZOELECTRIC ALARM

BACKGROUND OF THE INVENTION

This invention relates generally to an electronic timepiece including a piezoelectric type alarm buzzer, and more particularly to an electronic timepiece wherein the piezoelectric element is mounted on the timepiece back which functions as the buzzer diaphragm.

Conventional electronic timepieces, such as wristwatches including an alarm device with a vibrating caseback include constructions wherein a piezoelectric element is mounted to the caseback. These timepieces utilize the piezoelectric effect to generate sounds as is well known in the prior art. Generally speaking, the piezoelectric element is formed with electrodes on the upper and lower sides and is adhered to the caseback by means of a conductive adhesive. Conducting spring members are generally provided to connect the piezoelectric element to the alarm circuit of the timepiece movement and maintain a space between the piezoelectric element and the movement and battery. Generally, a sufficiently large gap is maintained between the battery and the piezoelectric element in order to prevent short-circuiting due to contact when the timepiece is subjected to pressure or impact.

An example of this type of construction is illustrated in U.S. Pat. No. 3,879,931. Alternatively, the patentees place the battery adjacent to the vibrating caseback which results in a diaphragm of reduced size, and consequently, reduced sound level. Accordingly, as a result of this, such prior art constructions are not totally satisfactory in that the thickness of the timepiece is increased significantly or the sound level is reduced. Accordingly, it is desirable to provide a timepiece including a piezoelectric alarm buzzer of reduced thickness which will not be subject to shortcircuiting between the battery and the piezoelectric element and will not affect adversely the sound level.

SUMMARY OF THE INVENTION

Generally speaking, in accordance with the invention, an electronic timepiece with a piezoelectric alarm type buzzer wherein the timepiece caseback functions as the buzzer diaphragm and is of reduced thickness is provided. The thickness of the timepiece is reduced by placing the timepiece battery and piezoelectric element in contact with each other through an insulating member or plate. Preferably, the battery contacts the piezoelectric element at a peripheral region through the insulating member. When the structure of the timepiece dictates that the timepiece battery be positioned towards the center of the piezoelectric element in plan view, an annular insulating member is mounted to the piezoelectric element about the periphery thereof and the battery is mounted thereon.

Accordingly, it is an object of the invention to provide an improved electronic timepiece including a piezoelectric alarm.

It is another object of the invention to provide an improved electronic timepiece to provide an improved electronic timepiece with a piezoelectric alarm of reduced thickness.

It is a further object of the invention to provide an improved electronic timepiece with a piezoelectric alarm wherein the timepiece caseback functions as the buzzer diaphragm.

Still another object of the invention is to provide an improved electronic wristwatch with a piezoelectric alarm with a piezoelectric element mounted to the wristwatch back.

Still a further object of the invention is to provide an improved electronic timepiece including a piezoelectric alarm wherein the wristwatch battery contacts the peripherial portion of the piezoelectric element mounted on the wristwatch back.

Yet a further object of the invention is to provide an improved electronic wristwatch with a piezoelectric alarm wherein a battery mounted in the center of the piezoelectric element in plan view contacts the peripheral portion through an annular insulating member.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
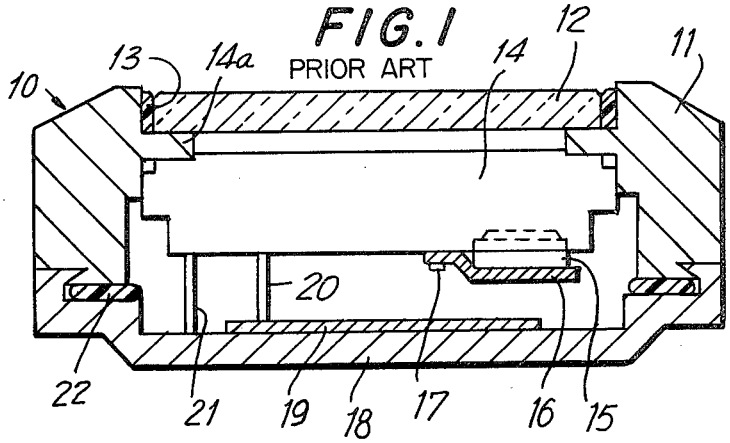
FIG. 1 PRIOR ART
FIG. 1 is a cross-sectional view of a wristwatch having a piezoelectric type alarm buzzer of conventional construction with a gap maintained between the piezoelectric element and battery.

FIG. 1 illustrates the basic structure of a wristwatch including an alarm device wherein a piezoelectric element is mounted to a vibrating caseback in accordance with the prior art.

Specifically, a wristwatch 10 includes a watch case 11 and a cover glass 12 for viewing a display of time therein. A gasket 13 compressively retains cover glass 12 within an opening in watch case 11. A watch movement 14 is positioned vertically within watch case 11 by an inwardly facing flange 14*a* formed in watch case 11. A battery 15 is mounted beneath movement 14 by a battery holding spring 16 fixed to the bottom of movement 14 by a screw 17. A piezoelectric element 19 is mounted on a caseback 18 which is selectively secured to watch case 11. A gasket 22 is compressed between the periphery of caseback 18 and watch case 11 for providing a water-tight seal within the interior of wristwatch 10. A pair of conducting spring members 20 and 21 for providing electrical connections to the electrodes of the piezoelectric element 19 are provided between movement 14 and electrodes on opposed surfaces of piezoelectric element 19.

According to this prior art construction, it is necessary to provide for a substantially large gap between battery holding spring 16 and piezoelectric element 19 in order to prevent shortcircuiting between battery 15 and piezoelectric element 19. Such short-circuiting may occur where contact is caused when wristwatch 10 subjected to high pressure or an impact. As a result of this type of construction, the defects are apparent as the thickness of wristwatch 10 is increased.

Figure 2:
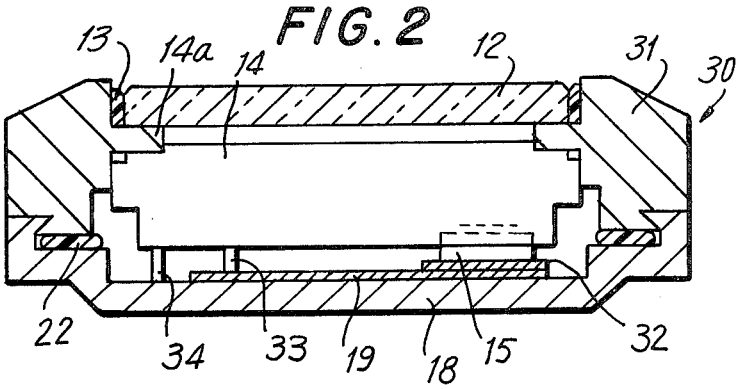
FIG. 2 is a cross-sectional view of an electronic wristwatch including a piezoelectric type alarm buzzer constructed and arranged in accordance with the invention.

The present invention is characterized in that the wristwatch battery and the piezoelectric element are made to contact each other through an insulating plate with a view to eliminating the aforementioned defect of the prior art constructions. Accordingly, the present invention will now be described with reference to the accompanying drawings. Referring specifically to FIG. 2, a wristwatch 30 including a piezoelectric-type alarm buzzer wherein the battery is in contact with the piezoelectric element through an insulating plate in accordance with a first embodiment of the invention is shown. The same reference numeral elements are utilized to describe the elements as in wristwatch 10 of FIG. 1. Wristwatch 30 includes a watch case 31 of reduced thickness compared to watch case 11 of wristwatch 10 in view of the fact that a gap between battery 15 and piezoelectric element 19 need no longer be maintained. Specifically, an insulating plate 32 is mounted on piezoelectric element 19 and battery 15 is directly mounted to insulating plate 32. In the embodiment illustrated herein, the plus terminal of battery 15 contacts piezoelectric element 19 through insulating plate 32.

In accordance with this embodiment of the invention, insulating plate 32 may be either merely placed in position or fixedly adhered to the plus terminal of battery 15, or to piezoelectric element 19. Compared with the prior art construction as illustrated in FIG. 1, short-circuiting due to contact between battery 15 and piezoelectric 19 is entirely avoided by utilizing insulating plate 32 in place of battery holding spring 16, in case high pressure or impact is applied to the wristwatch. Additionally, the cost of manufacturing of wristwatch 30 can be reduced. By having battery 15 and piezoelectric element 19 in contact through thin insulating plate 32 the gap between battery holding spring 16 and piezoelectric element 19 according to the prior art construction of FIG. 1 can be eliminated so that the thickness of wristwatch 30 can be reduced. By reducing the distance between caseback 18 and movement 14, shortened conducting spring members 33 and 34 are used in the construction of FIG. 2.

It is conceivable that when a wristwatch is constructed in accordance with this embodiment of the present invention, the sound level may be adversely effected due to the contact of battery 15 and piezoelectric element 19 through insulating plate 32. It is anticipated that there are many causes for such an adverse result. The position of contact between the battery 15 and piezoelectric element 19 as well as the contacting pressure therebetween may cause the lowering of sound level. With respect to the contacting position, it has been found that the sound level is not adversely effected in the least, if battery 15 contacts piezoelectric element 19 in the peripherial portion of piezoelectric element 19.

Figure 3:
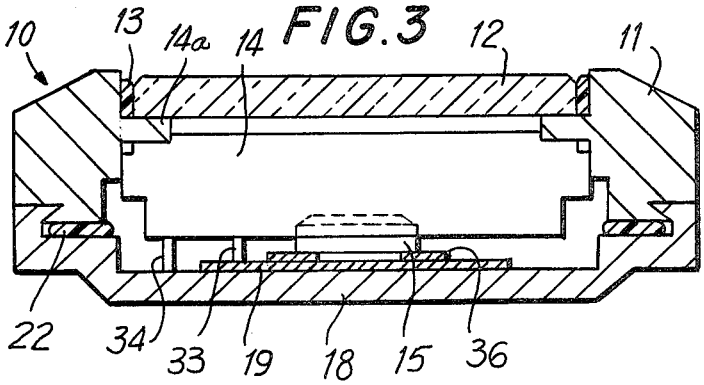
FIG. 3 is a cross-sectional view of an electronic wristwatch having a piezoelectric type alarm buzzer constructed and arranged in accordance with another embodiment of the invention.
Figure 4:
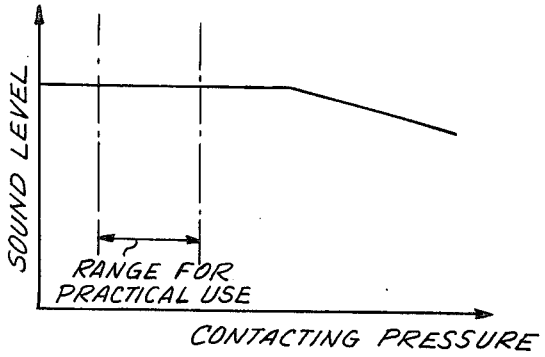
FIG. 4 is a graph illustrating the relationship between the contacting pressure between the battery and the piezoelectric element and the sound level.

There are some wristwatch constructions wherein it is necessary that battery 15 be positioned towards the center of piezoelectric element 19. Such a construction is shown in the embodiment of the invention illustrated in FIG. 3. In accordance with this embodiment of the invention an insulating plate 36 having an annular shape is positioned between battery 15 and piezoelectric element 19. By providing such an annular shape for insulating plate 36, battery 15 actually contacts the peripheral portion of piezoelectric element 19. It has also been confirmed experimentally that the sound level is not adversely effected within a practical range as shown in FIG. 4.

It would also appear possible that in a construction in accordance with the invention piezoelectric element 19 may be forced into contact with battery 15 and caseback 18 upon impact so as to crack piezoelectric element 19. It has also been confirmed experimentaly by drop tests and the Sharpy impact test that piezoelectric element 19 does not crack under these circumstances.

Figure 5:
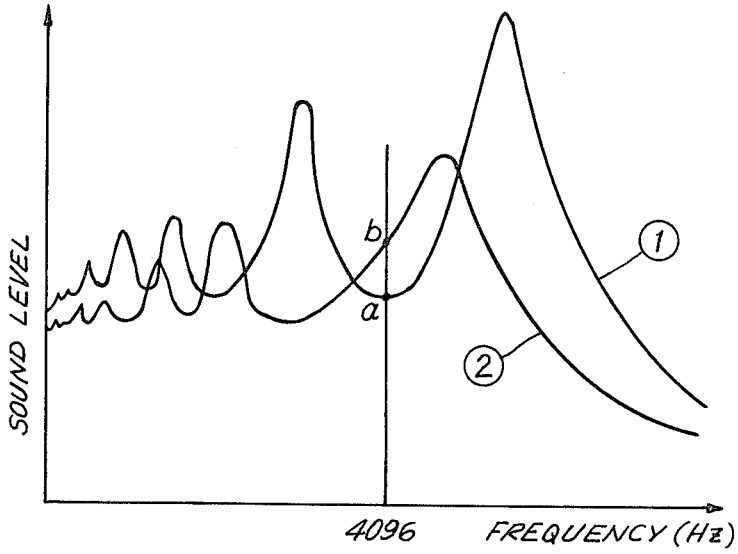
FIG. 5 is a graph illustrating the relationship between the drive frequency of the piezoelectric element of a timepiece and the sound level.

The influence upon the frequency characteristics as a result of the fact that the battery and the piezoelectric element are in contact through the insulating plate has also been considered. It has been found that the influence is insignificant in the case of a wristwatch constructed and arranged in accordance with the present invention. Referring to FIG. 5, the changes in the frequency characteristics due to the construction wherein the battery contacts the piezoelectric element compared to the prior art constructions are shown. Curve 1 in FIG. 5 corresponds to the case wherein the battery does not contact the piezoelectric element as in the prior art constructions and curve 2 corresponds to the construction wherein the battery contacts the piezoelectric element in accordance with the invention.

Figure 6:
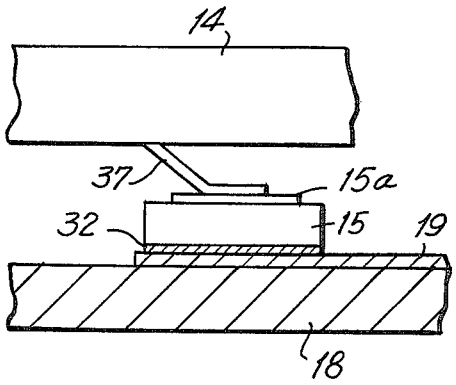
FIG. 6 is a partial cross-sectional view of the structure surrounding the battery in the wristwatch illustrated in FIG. 2.

Referring specifically to FIG. 6, the structure surrounding battery 15 is shown in detail for a construction of the type illustrated in FIG. 2. A conducting spring member 37 electrically connects the negative terminal 15*a* of battery 15 to movement 14. In this construction battery 15 is supported on one side by spring member 37 so that caseback 18 and battery 15 vibrate together when the alarm is driven. Specifically, the mass of the vibrating body is increased so that the resonance frequency is shifted to a lower value. Here, the shift can be expressed by the following equation:

$$f_1 - f_2 = \frac{1}{2\pi}\left(\sqrt{k/m_1} - \sqrt{k/(m_1 + m_2)}\right)$$

In this equation the resonance frequency under the condition wherein the battery does not contact the piezoelectric element is denoted as $f_1$; the resonance frequency under the contacting condition is denoted as $f_2$; the spring constant of the caseback is denoted as K; the mass of the caseback is denoted as $m_1$; and the mass of the battery is denoted as $m_2$.

Generally speaking, the overall sound level of the alarm is lowered by the battery contacting the piezoelectric element, because the battery acts as a damper against vibration. However, in an alarm drive of an electronic timepiece or wristwatch, there are many cases wherein the drive is effected at a fixed frequency and it is sufficient that the sound level at that drive frequency be preserved. According to an embodiment of the invention wherein the alarm device is driven at a frequency of 4096 Hz (which is the frequency used for the driving for the driving operation in conventional alarm wristwatches), the sound level shifts from a point (a) of frequency characteristic curve 1 of FIG. 5 to a point (b) of curve 2 as shown in FIG. 5. Thus, placing the battery in contact with the piezoelectric electric element actually results in an increase in the sound level at the alarm drive frequency.

Figure 7:
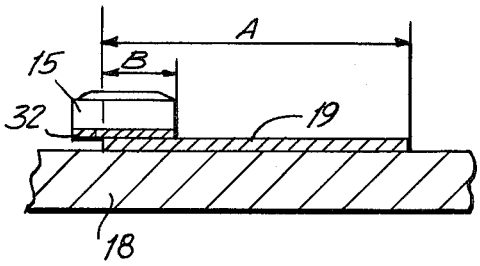
FIG. 7 is a partial cross-sectional view of a battery mounted on a piezoelectric element in accordance with the invention.
Figure 8:
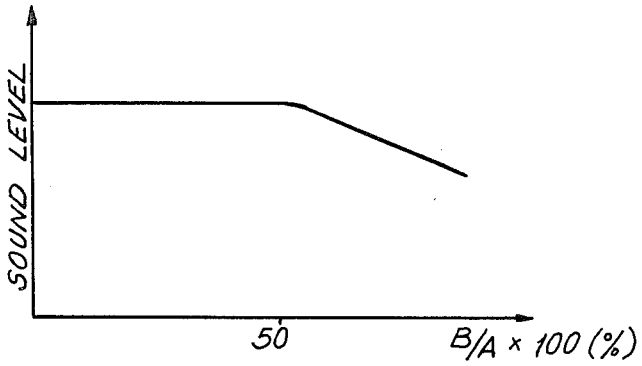
FIG. 8 is a graph illustrating the relationship between the contacting position of the battery and piezoelectric element in the construction of FIG. 7 and the sound level emitted by the alarm.

FIG. 8 illustrates the relationship between the contacting position between battery 15 and piezoelectric element 19 and the sound level for the construction of the type illustrated in FIG. 7. Based on this relationship, it is apparent that there is little change in the sound level so long as the ratio B/A is within about 50%. A is the diameter of a substantially circular piezoelectric element 19 and B is the distance from the edge of piezoelectric element 19 to the inner point of overlap with battery 15. Based on this, it is desirable to design a wristwatch wherein battery 15 is disposed at a position within about the outer half of the diameter of piezoelectric element 19.

Figure 9:
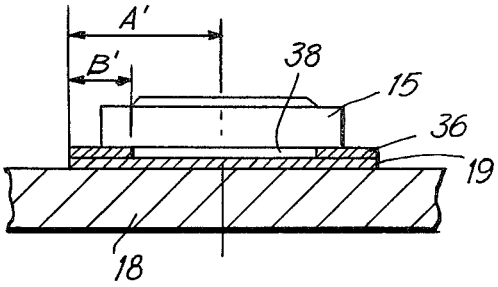
FIG. 9 is a partial cross-sectional view of a battery mounted to a piezoelectric element in accordance with the invention.
Figure 10:
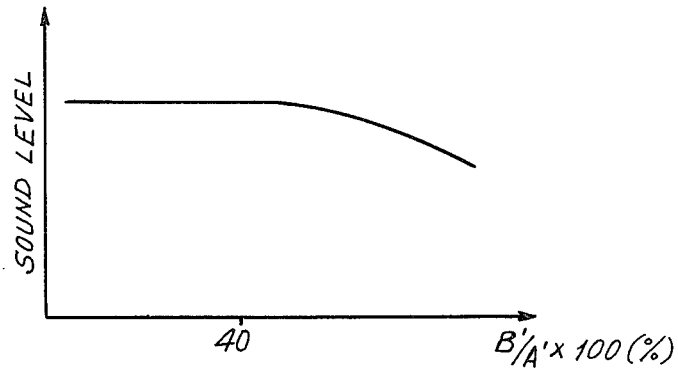
FIG. 10 is a graph illustrating the relationship between the contacting position of the battery and piezoelectric element in the construction of FIG. 9 and the sound level emitted by the alarm.

Often there are cases wherein battery 15 is required to be positioned at the central portion of the wristwatch movement and piezoelectric element 19 due to design requirements. In these constructions battery 15 is made to contact with the peripherial portion of the piezoelectric element 19 by the use of an insulating plate 36 having an annular shape with a central opening 38 as shown in detail in FIG. 9. In this case battery 15 only contacts piezoelectric element 19 in the region of the annulus of insulating plate 36. The relationship between contacting position and the sound level for this embodiment is shown in FIG. 10. For a wristwatch constructed in accordance with this embodiment, it has been found that there is little change in sound level if the ratio $B'/A' \times 100$ is maintained within about 40%. A' is the radius of a disc shaped annular piezoelectric element 36 and B' is the width of the annulus of insulating plate 36.

As has been described herein, the present invention provides a wristwatch with an alarm device utilizing a piezoelectric-type buzzer wherein the caseback functions as the buzzer diaphragm. The constructions in accordance with the invention are characterized in that the battery and the piezoelectric element are made to contact with each other through an insulating plate. This is in contrast to prior art constructions wherein a gap is maintained between the watch movement and/or battery and the piezoelectric element in order to prevent short-circuiting. Such short-circuiting is completely avoided in accordance with the invention by using an insulating plate of a polyester film, or like material in place of battery holding springs. Not only is the short-circuiting problem avoided, but the gap which heretofore was formed between the battery holding spring and the piezoelectric element can be eliminated so that a wristwatch having a thinner overall construction is possible. Thus, many practical effects are obtained in accordance with the invention.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic timepiece including a piezoelectric type alarm buzzer comprising:

a timepiece case having a front side with an opening for viewing a display of time and an opposed caseback;

a timepiece movement for generating at least a display of time and alarm drive signals and a battery for driving said movement, said movement and battery disposed within said timepiece case;

a substantially planar piezoelectric element electrically coupled to said movement and mounted on said caseback wherein said element has a dimension of at least length A in a radial direction on the caseback;

an electrical insulating member contacting a portion of said piezoelectric element; and said battery is substantially circular in plan view and is mounted on said insulating member, said insulating member overlaps said piezoelectric element a distance B, the ratio B/A being about 0.5 or less.

2. The electronic timepiece of claim 1, wherein said battery contacts the insulating member at the peripheral region of the piezoelectric element.

3. The electronic timepiece of claim 2, wherein said insulating member is of an annular shape having a central opening and the battery is disposed over the opening in contact with the annulus of the insulating member for contacting said piezoelectric element at the periphery thereof.

4. The electronic timepiece of claim 1, further including biasing means disposed between said timepiece movement and said battery for making the electrical contact therebetween and for biasing said battery against said insulating member.

5. The electronic timepiece of claim 1, wherein the insulating member is annular shaped.

6. The electronic timepiece of claims 1, or 5, wherein the drive frequency of the alarm is 4096 Hz.

7. The electronic timepiece of claim 6, wherein said electronic timepiece is a wristwatch.

8. An electronic timepiece including a piezoelectric type alarm buzzer comprising:

a timepiece case having a front side with an opening for viewing a display of time and an opposed caseback;

a timepiece movement for generating at least a display of time and alarm drive signals and a battery for driving said movement, said movement and battery disposed within said timepiece case;

a substantially planar piezoelectric element electrically coupled to said movement and mounted on said caseback;

an electrical insulating member contacting a portion of said piezoelectric element; and the piezoelectric element is substantially circular having a diameter A and said battery is mounted on said insulating member and is substantially circular in plan view and contacts said piezoelectric element a distance B, the ratio B/A being about 0.5 or less.

9. An electronic timpeiece including a piezoelectric type alarm buzzer comprising:

a timepiece case having a front side with an opening for viewing a display of time and an opposed caseback;

a timepiece movement for generating at least a display of time and alarm drive signals and a battery for driving said movement, said movement and battery disposed within said timepiece case;

a substantially planar piezoelectric element electrically coupled to said movement and mounted on said caseback in the radial direction on the caseback;

an electrical insulating member having an annular shape with the annulus having a dimension B′ contacting said piezoelectric element at the periphery thereof; and the piezoelectric element is disc shaped having a radius A′ and the battery is substantially circular in plan view and contacts the piezoelectric element at the insulating member, the ratio B′/A′ being about 0.4 or less.

10. An electronic wristwatch including a piezoelectric type alarm buzzer comprising:

a watch case having a front side formed with an opening for viewing a display of time and an opposed caseback;

a wristwatch movement for generating a display of time and an alarm signal disposed within said wristwatch case;

a piezoelectric plate mounted on said caseback;

an electrical insulating plate mounted on a portion of said piezoelectric plate;

a battery disposed in contact with said insulating plate; and resilient conductive means disposed between said movement and said battery for maintaining electrical contact therebetween for driving the movement and the alarm and biasing said battery into contact with said insulating plate, said battery and insulating plate contacting the piezoelectric element at the periphery thereof.

* * * * *